US006115980A

United States Patent [19]

Knak et al.

[11] Patent Number: 6,115,980

[45] **Date of Patent: *Sep. 12, 2000**

[54] PARKING GARAGE EXPANSION JOINT COVER

[75] Inventors: Ron Knak; Johnnie D. Hilburn, Jr., both of Wichita, Kans.

[73] Assignee: Balco/Metalines, Wichita, Kans.

[ * ] Notice: This patent is subject to a terminal disclaimer.

[21] Appl. No.: 09/183,457

[22] Filed: Oct. 30, 1998

[51] Int. Cl.[7] ..... E04B 1/68

[52] U.S. Cl. ..... 52/396.04

[58] Field of Search ..... 52/396.04, 396.05, 52/396.08, 396.09

[56] References Cited

U.S. PATENT DOCUMENTS 3,864,886 2/1975 Thom ..... 52/396.04 X
5,584,152 12/1996 Baerveldt ..... 52/396.04 X

*Primary Examiner*—Christopher T. Kent
*Attorney, Agent, or Firm*—Hovey, Williams, Timmons & Collins

[57] ABSTRACT

An expansion joint cover apparatus (10) includes a cover plate (38) in covering relationship with the gap (12) between building sections(14,16). One edge (46) of the plate (38) is coupled to one building section (14) and the opposed edge (48) is slidably received in a recess (30) defined in the second building section (16) adjacent the gap (12). The second building section (16) includes a recess wall (34) between the recess (30) and the adjacent support surface (28). The apparatus (10) further includes a transition insert (44) mounted in the recess (30) against the recess wall (34). The insert (44) presents an insert wall (66) to provide a beveled transition between the recess area (30) and the support surface (28) in order to guide the plate edge (48) therebetween during relative movement between the building sections (14,16) and to protect the recess wall (34) from impact by the second edge (48) of the plate (38) during such movement.

38 Claims, 1 Drawing Sheet

10
12
14
16
18
20
22
24
26
28
30
32
34
36
38
40
42
44
46
48
50
52
54
56
58
60
60a
60b
62
64
66
68
70
72

PARKING GARAGE EXPANSION JOINT COVER

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of expansion joint covers for buildings. In particular, the invention is concerned with an expansion joint cover apparatus having a cover plate in covering relationship with the gap between building sections wherein one edge of the plate is coupled to one building section and the opposed edge is slidably received in a recess defined in the second building section adjacent the gap.

2. Description of the Prior Art

The prior art concerning expansion joint covers includes a cover plate in covering relationship with an expansion gap between first and second building sections. The first edge of the plate is coupled to the first section and the opposed, second edge is slidably received in a transition recess defined in the surface of the second section adjacent the gap. The second edge slides in the recess during relative movement of the building sections caused by thermal expansion and contraction.

The second section presents a beveled recess wall at the juncture between the recess and the adjacent, upper surface of the building section. During a seismic event, the gap may narrow such that the second edge of the plate slides over the recess wall onto the upper surface of the second building section. The building sections are typically formed of concrete and the recess wall is subject to spalling, corrosion and potential impact damage from the second edge of the plate during a seismic event.

SUMMARY OF THE INVENTION

The present invention solves the prior art problems mentioned above and provides a distinct advance in the state of the art. In particular, the expansion joint apparatus hereof provides an expansion joint cover that remains effective during seismic events without damaging adjacent structural components or being exposed to damage thereby.

The preferred expansion joint cover apparatus includes a cover plate in covering relationship with the gap between building sections. One edge of the plate is coupled to one building section and the opposed edge is slidably received in a recess defined in the second building section adjacent the gap. The second building section includes a recess wall between the recess and the adjacent support surface. The apparatus further includes a transition insert mounted in the recess adjacent the recess wall. The insert presents an insert wall to provide a beveled transition between the recess area and the support surface in order to guide the plate edge therebetween during relative movement between the building sections and to protect the recess wall from impact by the second edge of the plate during such movement. In preferred forms, the transition insert is composed of metal or synthetic resin material and can be integrally formed or can be made from two components including a base and a transition body including the insert wall.

In the preferred embodiment, the first building section includes a projecting extension with a mounting recess defined in the upper surface thereof for receiving the first edge of the plate and to which the plate is coupled. In particular, the preferred coupling assembly includes a tubular sleeve positioned through the extension, a bolt with a bolt head positioned against the upper face of the plate and extending therethrough and through the sleeve. A nut is threaded onto the exposed end of the bolt with a resilient washer positioned between rigid washers. One of the rigid washers is positioned between the end of the sleeve and the resilient washer. The other rigid washer is positioned between the resilient washer and the nut. This allows limited rotation of the plate about the first edge during relative movement of the building sections and protects the resilient washer from damage. Other preferred aspects of the invention are disclosed herein.

DETAILED DESCRIPTION OF THE PREFERRED EMBODIMENT

Figures 1, 2, 3:
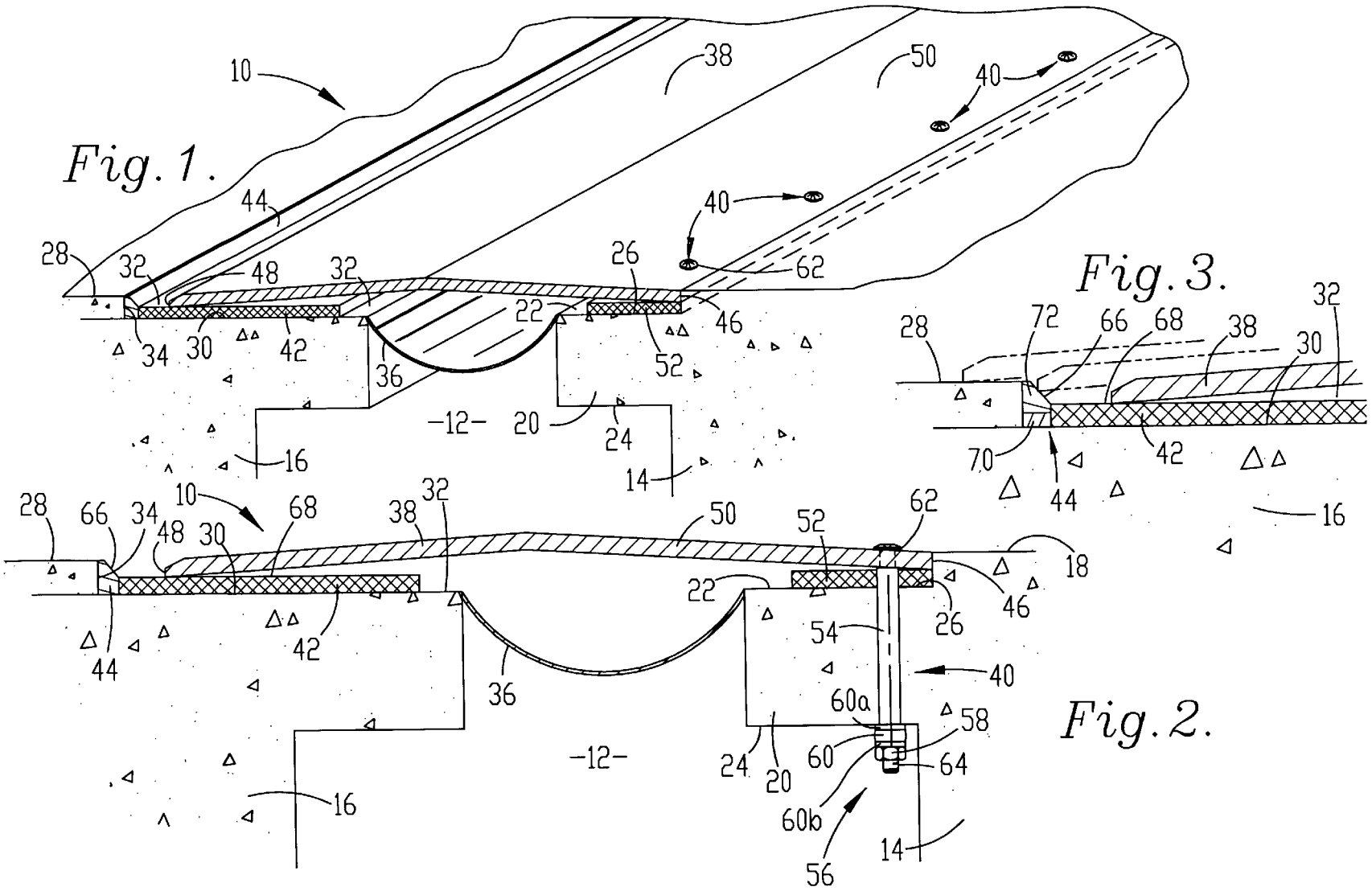
FIG. 1 is a pictorial view in partial section of the preferred expansion joint cover apparatus of the present invention shown as installed over an expansion gap between adjacent building sections.
FIG. 2 is a sectional view of the installation of FIG. 1.
FIG. 3 is a partial sectional view of another embodiment of the preferred transition insert of FIG. 1.

FIG. 1 illustrates preferred expansion joint cover apparatus 10 in accordance with the present invention. FIG. 1 shows apparatus 10 installed to span expansion gap 12 between first building section 14 and second building section 16 of a building such as a parking garage. Building sections 14, 16 are composed of concrete.

First building section 14 presents first upper surface 18 and includes projecting extension 20 adjacent gap 12. Extension 20 presents upper face 22 and lower face 24. Upper face 22 is below the level of first upper surface 18 to define mounting recess 26 adjacent gap 12 having a depth of about ¾".

Second building section 16 presents second upper surface 28 and is configured to define transition recess 30 having a depth of about ¾" adjacent gap 12. Recess 30 presents support area 32 below the level of second upper surface 28 and includes recess wall 34 between second upper surface 28 and support area 32.

Apparatus 10 includes water barrier 36, cover plate 38, coupling assemblies 40, support pad 42 and transition insert 44. Conventional water barrier 36 is composed of flexible PVC or EPDM and spans gap 12 between building sections 14, 16.

Cover plate 38 is preferably composed of ⅜" bent aluminum plate to present an arched configuration of about ½" for increased structural strength as illustrated in the drawing figures. Plate 38 extends along the length of gap 12 and is wide enough to span gap 12, and presents first edge 46 positioned in mounting recess 26 and second edge 48 positioned in transition recess 30.

Coupling assemblies 40 are spaced along the length of cover plate 38 adjacent first edge 36 and couple plate 38 with first building section 14. More specifically, assemblies 40 couple plate 38 to extension 20 with first edge 46 positioned in mounting recess 26 remote from gap 14 and with upper face 50 of plate 38 substantially flush with first upper surface 18. Resilient mounting pad 52, preferably composed of neoprene about ⅜" thick, is positioned between plate 38 and upper face 22 of extension 20.

Each coupling assembly 40 includes tubular sleeve 54, bolt 56, nut 58 and resilient washer 60. Sleeve 54 extends between upper and lower faces 22, 24 of extension 20 and provides a passage for receiving the shank of bolt 56. In the preferred embodiment, first building section 14 is designed to include extension 20 with sleeve 54 installed during construction before pouring the concrete that makes up first building section 14.

Bolt 56 extends through cover plate 38 adjacent first edge 46, through mounting pad 52, and through sleeve 54 so that bolt head engages upper face 50 of plate 38. Bolt 56 is long enough so that threaded end 64 extends through the lower end of sleeve 54 below lower face 24 of extension 20. Nut 58 is threadably received about threaded end 64. Resilient washer 60 along with rigid washers 60*a* and 60*b* positioned against opposed faces of washer 60 are also received on threaded end 64 snugly between the lower end of sleeve 54 and nut 58. The resilient nature of washer 60 allows limited rotation of plate 38 about first edge 46, while rigid washers 60*a,b* protect resilient washer 60 from damage during such movement. For example, upward movement of second edge 48 rotates plate 38 about first edge 46. This action pulls bolt 56 upwardly to further compress washer 60.

Support pad 42, about ⅜" thick, is preferably composed of resilient, synthetic material such as neoprene and is positioned in transition recess 30 between second edge 48 of plate 38 and support area 32. Pad 42 supports second edge 48 for sliding thereon during relative movement between building sections 14, 16.

Referring to FIGS. 1 and 2, transition insert 44 is integrally formed of metal such as steel or aluminum, synthetic resin material such as acrylic or hard elastomer, fiberglass or a composite material. Such materials are chosen as needed to withstand the expected loads of a particular installation. Insert 44 is positioned in transition recess 30 on support area 32 and against recess wall 34. Insert 44 is beveled to present insert wall 66 configured to provide a transition between support area 32 and second upper surface 28. In particular, insert wall 66 provides a transition between upper face 68 of mounting pad 52 and second upper surface 28.

In the preferred embodiment, transition recess 30 is wide enough so that second edge 48 remains therein supported by support pad 42 during expected widening and narrowing of gap 12 due to thermal expansion and contraction. However, during a seismic event, building sections 14, 16 may move toward one another by an amount so that second edge 42 slides over insert wall 66 onto second upper surface 28 as illustrated by the phantom lines in FIG. 3. During such movement, insert wall 66 guides second edge 48 between support area 32 and second upper surface 28.

Insert 44 is preferably composed of materials less subject to spalling and corrosion than the concrete making up recess wall 34. Because of this, insert 44 ensures reliable operation of apparatus 10 over the many years that the building may be in service. Moreover, insert 44 protects recess wall 34 from impact damage by second edge 48 during a seismic event.

FIG. 3 illustrates second embodiment of transition insert 44. In this embodiment, insert 44 is formed from two components. These include base 70 and transition body 72. Either may be composed of metal such as steel or aluminum, synthetic resin material such as acrylic or hard elastomer, fiberglass or a composite material. Transition body 72 is configured to present insert wall 66.

As those skilled in the art will appreciate, the present invention encompasses many variations in the preferred embodiments described herein. For example, the insert wall can present angles other than the preferred 45 degrees and a wide variety of known fastening techniques can be used to couple the cover plate with the first building section. Other variations can include different shapes of the various recesses. Also, the insert and support pad can be configured as a single component. Finally, the invention is useful for any type of building having an expansion gap and is useful with building sections composed of materials other than concrete. Having thus described the preferred embodiments of the present invention, the following is claimed as new and desired to be secured by Letters Patent:

What is claimed is:

1. An expansion joint cover apparatus for use in covering a gap between first and second building sections presenting respective first and second support surfaces, the second building section being configured to define a transition recess adjacent the gap presenting a support area below the level of the second support surface and including a recess wall between the second support surface and the recess support area, said apparatus comprising:

a cover plate presenting a first edge and an opposed second edge;

a coupling assembly for coupling said plate adjacent said first edge thereof with the first section adjacent the gap, and for positioning said plate in covering relationship with the gap and for positioning said second edge in the recess, said second edge being slidable during relative movement of the building sections; and a transition insert configured to mount in the transition recess adjacent the recess wall and including an insert wall configured to provide a beveled transition between the support area and the second support surface in order to guide said second edge therebetween during relative movement of the building sections and to protect the recess wall from impact by said second edge during said movement, the first section presenting a mounting recess adjacent the gap, said plate presenting an upper face, said coupling assembly including a mounting assembly for mounting said plate in the mounting recess with said upper face substantially flush with the upper surface of the first section.

2. The apparatus of claim 1, said cover plate presenting an arched configuration.

3. The apparatus of claim 1, said cover plate being composed of metal.

4. The apparatus of claim 3, said cover plate being composed of aluminum.

5. The apparatus of claim 1, said coupling assembly further including a resilient mounting pad configured for reception in the mounting recess adjacent said plate.

6. The apparatus of claim 1, said coupling assembly including bolts.

7. The apparatus of claim 1, said plate presenting an upper face, the first building section including a projecting extension adjacent the gap, said coupling assembly including a mounting assembly comprising:

a tubular sleeve configured for reception through the projecting extension to define a bolt passage therethrough, a bolt having a head positioned against said upper face of said plate, having a shank configured to extend through said plate and through said passage with said shank presenting a threaded end extending from said passage, a nut threadably coupled with the threaded end, and a resilient washer with respective rigid washers against opposed faces thereof positioned around said shank and positioned between said nut and said sleeve thereby allowing rotational movement of said plate about said second edge as said second edge shifts along said insert wall.

8. The apparatus of claim 7, including a plurality of said mounting assemblies spaced along said plate adjacent said first edge.

9. The apparatus of claim 7, said coupling assembly further including a resilient mounting pad configured for positioning between said plate and the projecting extension.

10. The apparatus of claim 9, said mounting pad being composed of neoprene.

11. The apparatus of claim 1, said insert being integrally composed of one of metal and synthetic resin material.

12. The apparatus of claim 11, said metal including one of steel and aluminum, said synthetic resin material including acrylic.

13. The apparatus of claim 1, said insert including a strap-shaped base and a separate transition body including said insert wall mounted on said base.

14. The apparatus of claim 13, said base being composed of one of metal and synthetic resin material, said transition body being composed of one of metal and synthetic resin material.

15. The apparatus of claim 14, said metal including one of aluminum and steel, said synthetic resin material including acrylic.

16. The apparatus of claim 1, said insert wall configured to present an angle of about 45 degrees relative to the second support surface.

17. The apparatus of claim 1, further including a support pad configured for positioning in the recess between said second edge of said plate and the second building section.

18. The apparatus of claim 1, the first building section including a projecting extension adjacent the gap and presenting a mounting recess adjacent the gap, said plate presenting an upper face, said coupling assembly including a mounting assembly for mounting said plate in the mounting recess with said upper face substantially flush with the upper surface of the first section, said coupling assembly including a resilient mounting pad configured for positioning between said plate and the projecting extension and including a plurality of mounting assemblies each comprising:

a tubular sleeve configured for reception through the projecting extension to define a bolt passage therethrough, a bolt having a head positioned against said upper face of said plate, having a shank configured to extend through said plate and through said passage with said shank presenting a threaded end extending from said passage, a nut threadably coupled with said threaded end, and a resilient washer with respective rigid washers against opposed faces thereof positioned around said shank and positioned between said nut and said sleeve thereby allowing rotational movement of said plate about said second edge as said second edge shifts along said insert wall, said apparatus further including a support pad configured for positioning in the transition recess between said second edge of said plate and the second building section, said insert wall configured to present an angle of about 45 degrees relative to the first upper surface.

19. In combination:

first and second building sections presenting respective first and second support surfaces, said building sections being spaced to present a gap therebetween, said second building section being configured to define a recess adjacent said gap presenting a support area below the level of said second support surface and including a recess wall between said second support surface and said recess support area; and an expansion joint cover apparatus covering said gap, said apparatus comprising:

a cover plate having a plate width greater than the width of said gap, said plate presenting a first edge and an opposed second edge;

a coupling assembly coupling said plate adjacent said first edge thereof with said first section adjacent said gap, positioning said plate in covering relationship with said gap and positioning said second edge in said recess; and a transition insert mounted in said recess adjacent said recess wall and including an insert wall presenting a beveled transition between said recess area and said second support surface in order to guide said second edge therebetween during relative movement of said building sections and to protect said recess wall from impact by said second edge during said movement, said first section presenting a mounting recess adjacent said gap, said plate presenting an upper face, said coupling assembly including a mounting assembly for mounting said plate in said mounting recess with said upper face substantially flush with said upper surface of said first section.

20. The apparatus of claim 19, said cover plate presenting an arched configuration.

21. The apparatus of claim 19, said cover plate being composed of metal.

22. The apparatus of claim 21, said cover plate being composed of aluminum.

23. The apparatus of claim 19, said coupling assembly including a mounting pad received in said mounting recess adjacent said plate.

24. The apparatus of claim 19, said coupling assembly including bolts.

25. The apparatus of claim 19, said plate presenting an upper face, said first building section including a projecting extension adjacent said gap, said mounting assembly comprising:

a tubular sleeve configured for reception through said projecting extension to define a bolt passage therethrough, a bolt having a head positioned against said upper face of said plate, having a shank extending through said plate and through said passage with said shank presenting a threaded end extending from said passage, a nut threadably coupled with said threaded end, and a resilient washer with respective rigid washers against opposed faces thereof positioned around said shank and positioned between said nut and said sleeve thereby allowing rotational movement of said plate about said second edge as said second edge shifts along said insert wall.

26. The apparatus of claim 25, including a plurality of said mounting assemblies spaced along said plate adjacent said first edge.

27. The apparatus of claim 25, said mounting assembly further including a resilient mounting pad configured for positioning between said plate and the projecting extension.

28. The apparatus of claim 27, said mounting pad being composed of neoprene.

29. The apparatus of claim 19, said insert being integrally composed of one of metal and synthetic resin material.

30. The apparatus of claim 29, said metal including one of steel and aluminum, said synthetic resin material including acrylic.

31. The apparatus of claim 19, said insert including a strap-shaped base and a separate transition body including said insert wall mounted on said base.

32. The apparatus of claim 31, said base being composed of one of metal and synthetic resin material, said transition body being composed of one of metal and synthetic resin material.

33. The apparatus of claim 32, said metal including one of aluminum and steel, said synthetic resin material including acrylic.

34. The apparatus of claim 19, said insert wall presenting an angle of about 45 degrees relative to said first upper surface.

35. The apparatus of claim 19, further including a support pad configured for positioning in the recess between said second edge of said plate and said second building section.

36. The apparatus of claim 19, the first building section including a projecting extension adjacent the gap and presenting a mounting recess adjacent the gap, said plate presenting an upper face, said coupling assembly including means for mounting said plate in the mounting recess with said upper face substantially flush with the upper surface of said first section, said coupling assembly including a resilient mounting pad configured for positioning between said plate and the projecting extension and including a plurality of mounting assemblies each including a tubular sleeve configured for reception through the projecting extension to define a bolt passage therethrough, a bolt having a head configured for positioning against said upper face of said plate, having a shank configured to extend through said plate and through said passage with said shank presenting a threaded end extending from said passage, a nut configured to threadably couple with the threaded end, and a resilient washer with respective rigid washers against opposed faces thereof positioned around said shank and positioned between said nut and said sleeve thereby allowing rotational movement of said plate about said second edge as said second edge shifts along said insert wall, said apparatus further including a support pad configured for positioning in the transition recess between said second edge of said plate and said second building section, said insert wall presenting an angle of about 45 degrees relative to said first upper surface.

37. A cover apparatus for spanning an expansion joint between two building sections, at least one of these sections presenting upper and lower tiers connected by a recess wall, said apparatus comprising:

a cover plate presenting first and second edges;

at least one coupling assembly removably attached to said first edge and adapted to secure said first edge adjacent one of the building sections;

said second edge for being slidably positioned on the lower tier of the other building section and shiftable between the lower and upper tiers of the other building section in response to relative movement between the two building sections; and a transition insert for being positioned adjacent the recess wall, said insert for presenting a beveled transition between the lower tier and the upper tier for providing a transition support surface wherein said second edge slides along said transition insert when shifting between the lower and upper tier.

38. A method of reducing damage between two building sections having a gap therebetween, at least one of the building sections presenting lower and upper tiers connected by a recess wall comprising the steps of:

(1) providing the apparatus of claim 37;

(2) coupling said first edge to one of the building sections;

(3) securing said transition insert to the recess wall on the other building section; and (4) slidably positioning said second edge on the lower tier of the other building section whereby, in response to relative movement between the building sections, said second edge slides along the lower tier of the other section, contacts said transition insert and shifts from the lower tier to the upper tier by sliding along said transition insert.

* * * * *